US007080934B1

(12) United States Patent
Zarian

(10) Patent No.: US 7,080,934 B1
(45) Date of Patent: Jul. 25, 2006

(54) ILLUMINATED CAPS FOR CONTAINERS AND DISPLAY RACKS FOR ENERGIZING THEM

(76) Inventor: James R. Zarian, 3079 Harbor Blvd., Santa Ana, CA (US) 92625

( * ) Notice: Subject to any disclaimer, the term of this patent is extended or adjusted under 35 U.S.C. 154(b) by 41 days.

(21) Appl. No.: 10/748,860

(22) Filed: Dec. 29, 2003

Related U.S. Application Data

(60) Provisional application No. 60/436,576, filed on Dec. 27, 2002.

(51) Int. Cl.
*H01R 33/00* (2006.01)

(52) U.S. Cl. ..... 362/640; 362/647; 362/652; 362/658

(58) Field of Classification Search ..... 362/640, 362/647, 652, 655, 656, 658, 800, 125, 132, 362/154, 155, 234; 220/521, 796
See application file for complete search history.

(56) References Cited

U.S. PATENT DOCUMENTS

| | | | | |
|---|---|---|---|---|
| 3,777,137 | A * | 12/1973 | Blackman et al. | 362/382 |
| 3,966,332 | A | 6/1976 | Knapp et al. | |
| 4,267,509 | A | 5/1981 | Graham | |
| 4,422,719 | A | 12/1983 | Orcutt | |
| 4,471,414 | A * | 9/1984 | Savage, Jr. | 362/652 |
| 4,647,162 | A | 3/1987 | Godard et al. | |
| 5,504,663 | A | 4/1996 | Tucker | |
| 5,785,407 | A | 7/1998 | Ratcliffe | |
| 5,816,171 | A | 10/1998 | Fitts, Jr. | |
| 6,044,532 | A | 4/2000 | Bowling et al. | |
| 6,352,352 | B1 | 3/2002 | Schletterer et al. | |
| 6,409,970 | B1 | 6/2002 | Phifer | |
| 6,443,589 | B1 | 9/2002 | Lee | |
| 6,511,197 | B1 | 1/2003 | Kalemjian | |
| 6,513,951 | B1 | 2/2003 | Wang et al. | |
| 6,523,969 | B1 * | 2/2003 | Yang et al. | 362/118 |
| 6,527,402 | B1 | 3/2003 | Borri | |
| 6,575,855 | B1 | 6/2003 | Buzak et al. | |
| 6,634,762 | B1 | 10/2003 | Cilia | |
| 6,655,812 | B1 | 12/2003 | Parker et al. | |
| 6,669,352 | B1 | 12/2003 | McKinney | |

(Continued)

FOREIGN PATENT DOCUMENTS

| | | |
|---|---|---|
| EP | 0 549 604 B1 | 4/1995 |

(Continued)

*Primary Examiner*—Sandra O'Shea
*Assistant Examiner*—Mark Tsidulko

(57) ABSTRACT

A cap for a container, having a light source contained within the cap, and a pair of conductors adapted to be in contact with a source of current exterior to the cap, the conductors being disposed so as to conduct current to illuminate the light source when they are in contact with the source of current exterior to the cap. The light source is desirably an LED. The cap fits a holder, which has means for detachably contacting the cap, desirably having spring action, and conductors providing a source of current to the pair of conductors in the cap when the cap is in contact with the holder.

The holder desirably has multiple portions for use with at least a multiplicity of containers having such caps. The invention also includes a display rack, comprising means, e.g. LEDs, for directing light onto the top of each of a plurality of containers having a translucent cap.

3 Claims, 5 Drawing Sheets

U.S. PATENT DOCUMENTS

| | | | | |
|---|---|---|---|---|
| 6,827,463 | B1 * | 12/2004 | Chuang et al. | 362/92 |
| 2001/0032655 | A1 | 10/2001 | Gindi | |
| 2002/0057566 | A1 | 5/2002 | Naghi | |
| 2002/0067608 | A1 | 6/2002 | Kruse et al. | |
| 2003/0026088 | A1 | 2/2003 | Vanderschuit | |
| 2003/0063460 | A1 | 4/2003 | Nadel | |
| 2003/0076672 | A1 | 4/2003 | Head | |
| 2003/0090897 | A1 | 5/2003 | Su | |
| 2003/0231484 | A1 | 12/2003 | Segel | |
| 2004/0001332 | A1 | 1/2004 | Salowicj | |
| 2004/0004829 | A1 | 1/2004 | Policappelli | |
| 2004/0004830 | A1 | 1/2004 | Rudell et al. | |
| 2004/0264171 | A1 | 12/2004 | King et al. | |

FOREIGN PATENT DOCUMENTS

| | | | |
|---|---|---|---|
| EP | 1 054 376 | A2 | 11/2000 |
| JP | 63258987 | A2 | 10/1988 |
| WO | WO 01/02282 | A1 | 1/2001 |
| WO | WO 01/90640 | A1 | 11/2001 |

* cited by examiner

ILLUMINATED CAPS FOR CONTAINERS AND DISPLAY RACKS FOR ENERGIZING THEM

CROSS-REFERENCE TO RELATED APPLICATIONS

This application claims benefit of the Provisional U.S. Patent Application entitled Lighted Cap, Ser. No. 60/436,576, which was mailed Dec. 11, 2002, and filed as of Dec. 27, 2002, by James R. Zarian, a copy of which is attached hereto for reference purposes, the disclosure of which is also incorporated herein by reference.

BACKGROUND

Light forms for illumination have gained tremendous interest recently. LEDs (Light emitting diodes) as a light source have also been used extensively because of dazzling color, high flux, energy efficiency among other attributes. One of the more interesting attributes of LEDs is the compactness and small footprint.

SUMMARY OF THE INVENTION

Figure 1:
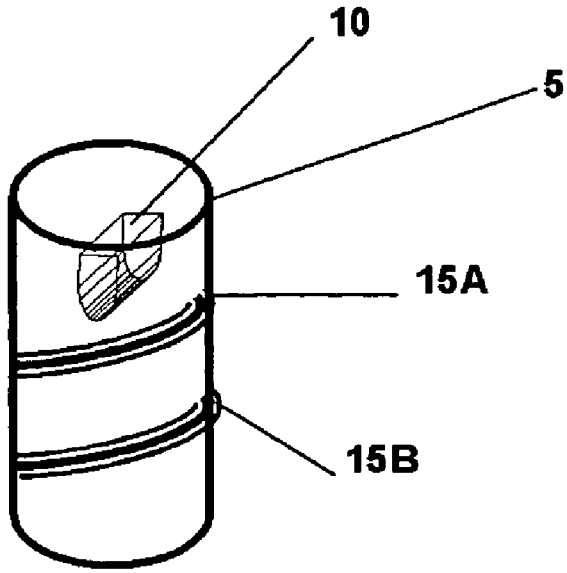

A cap 5 for a container that comprises of a light source such as an LED 10, is contained within the cap 5 and conductors 15A and 15B are placed without the cap as depicted in FIG. 1.

Figure 2:
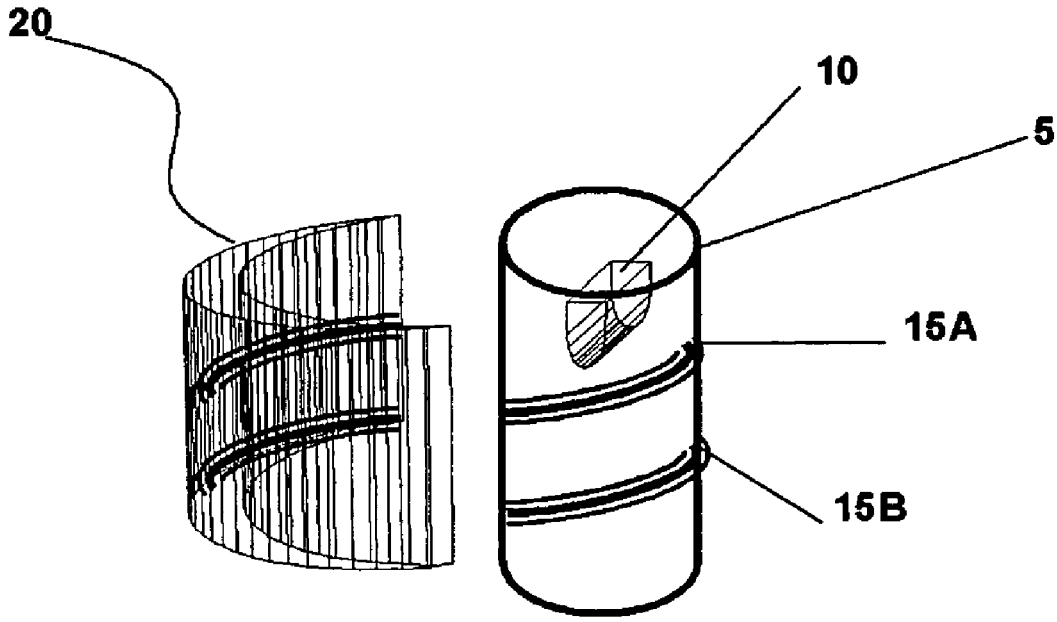

This embodiment attached to a container, then can be held in a holder 20 capable of conducting current to the cap as depicted in FIG. 2.

The holder may have spring action, whereby once the cap is inserted into the holder, contact is made and the cap projects light into the contents of the container lighting the same.

Figure 3:
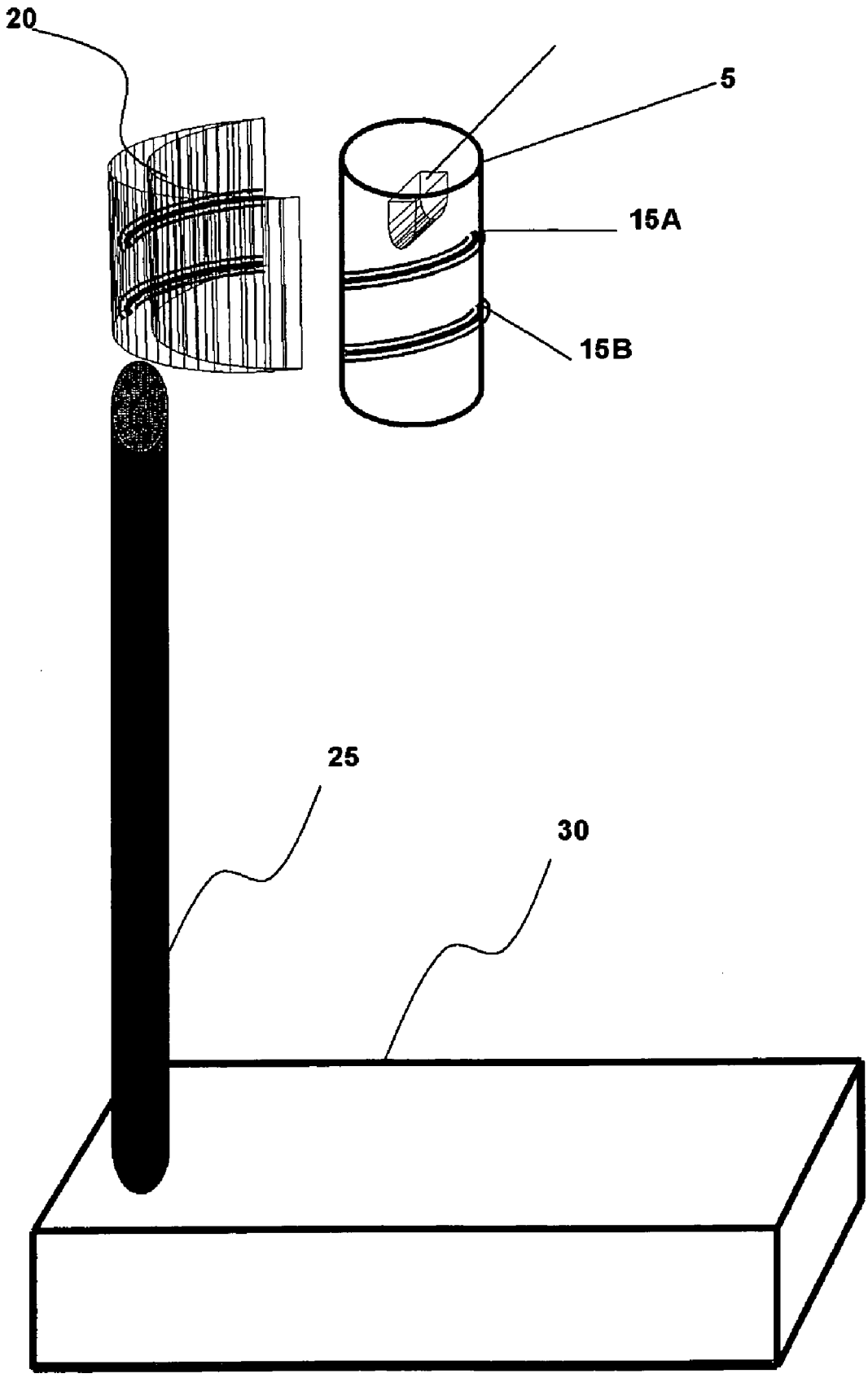

The holder may also have a stem 25 attached to it as depicted below as well as a base 30 containing an energy source such as batteries, as shown in FIG. 3.

Figure 4:
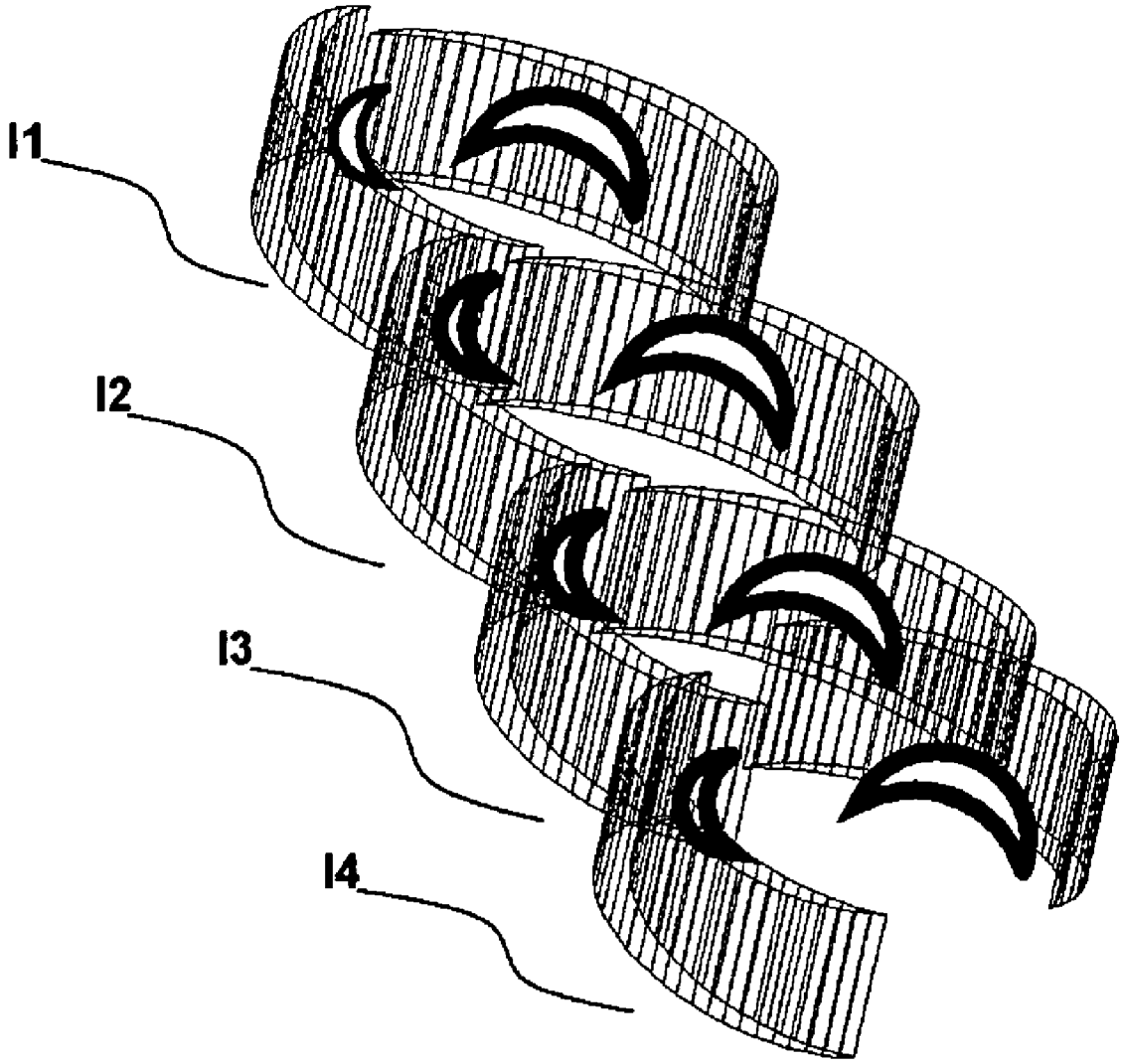

In another embodiment a holder may be provided as arranged as shown in FIG. 4.

The holder is provided with conductors and containers including the cap can slide from one portion of the holder to the next and fall into place at predetermined intervals, indicated as I1 through I4. In such an arrangement a group of containers would be lit and as one container is removed, another container would fall into place and remain lit.

Figure 5:
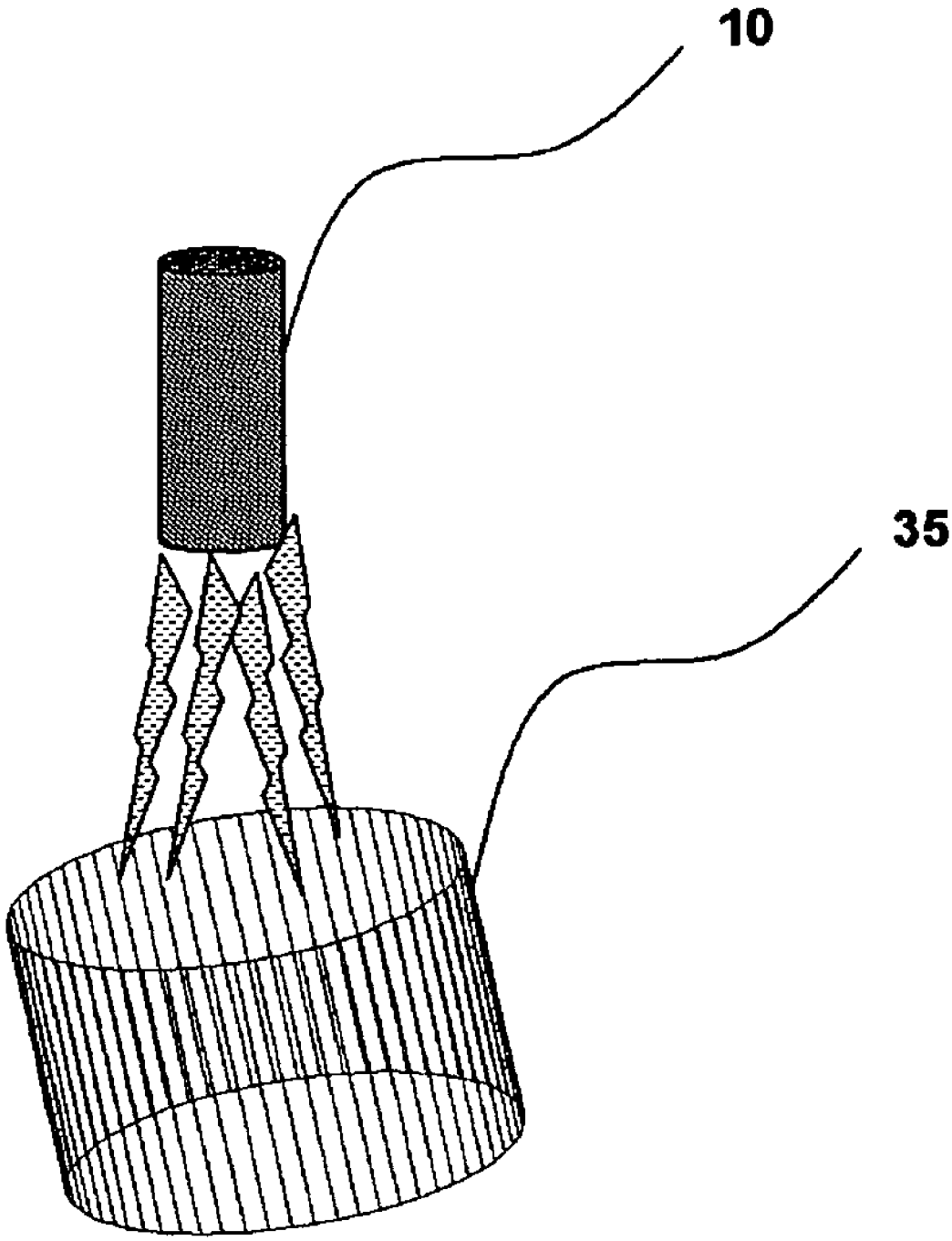

In certain arrangements the inclusion of an LED as the product is sold may be prohibitive or a large intensity of light may be needed. In such circumstances, the container(s) may be provided with a clear cap 35 and light from an LED 10 projected into the container as depicted in FIG. 5.

Figure 6:
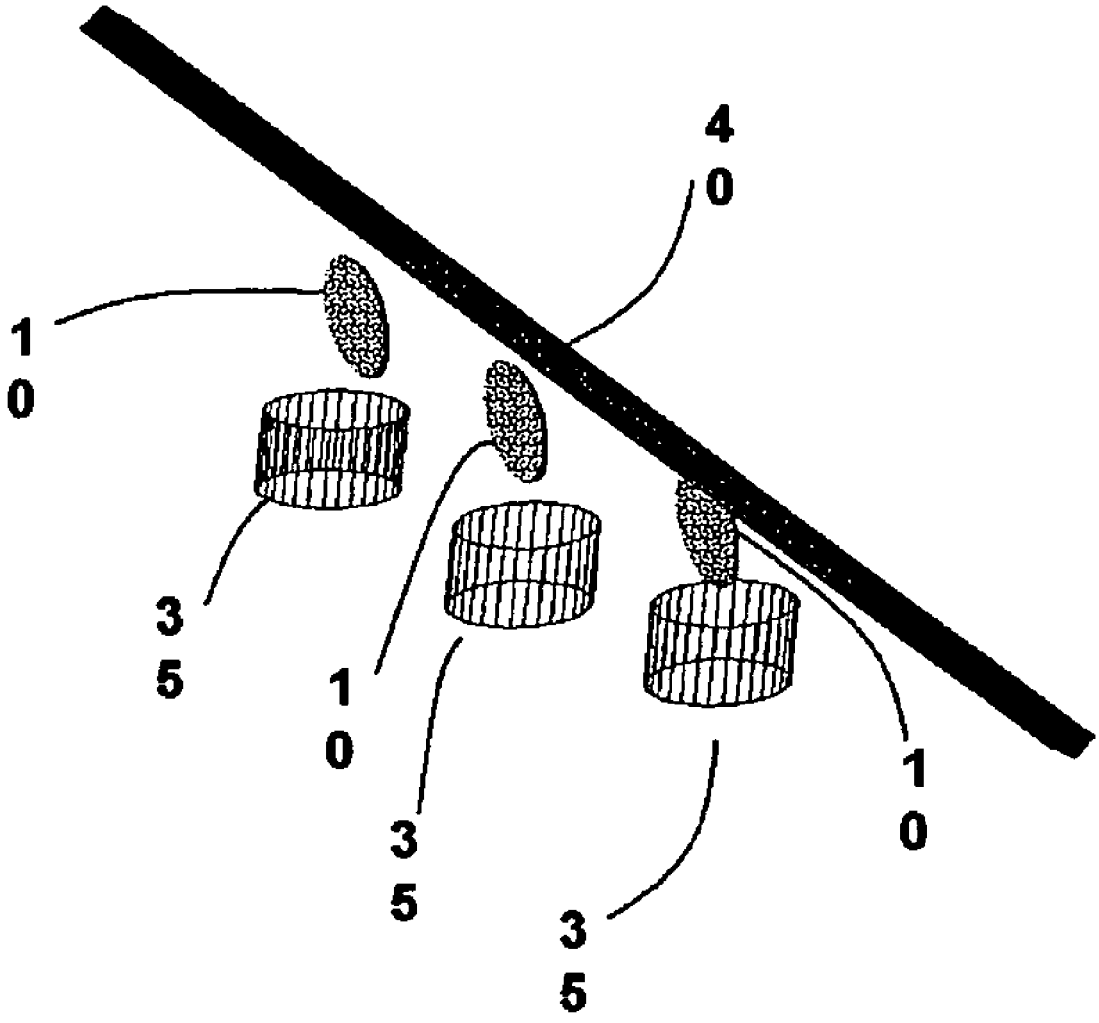

In one embodiment a series of LEDs may be arranged on a rack 40 and the rack 40 may also contain a guide (not shown) to place the LEDs 10 onto the caps 35 illuminating the contents of the bottles as depicted in FIG. 6.

I claim:

1. A holder for a container having a cap, said can comprising:

a light source contained within the cap; and a pair of conductors adapted to be in contact with a source of current exterior to the cap, the conductors being disposed so as to conduct current to illuminate the light source when they are in contact with the source of current exterior to the cap;

said holder comprising means for detachably contacting the cap, and conductors providing a source of current to the pair of conductors in the cap when the cap is in contact with the holder, said holder having multiple portions for use with at least a multiplicity of containers having such caps, wherein a) there are a plurality of similar means for detachably contacting the cap, and each means has a cross section substantially in the form of a pair of parentheses, and wherein b) the means for detachably contacting the cap are so disposed that each container including its cap can slide from one portion of the holder to the next and fall into place at predetermined intervals, whereby a group of containers would be lit and as one container is removed, another container would fall into place and remain lit.

2. A display rack comprising means for directing light into the top of each of plurality of containers having a clear cap, wherein the means for directing light is a plurality of light emitting diodes disposed at position immediately above locations where a container cap is intended to be located, further comprising a guide including a plurality of similar means for guiding the containers, wherein each means has a cross section substantially in the form of pair of parentheses, and wherein the guide permits each container including its cap to slide from one portion of the rack to the next and fall into place at predetermined intervals, whereby a group of containers would be lit and as one container is removed, another container would fall into place and remain lit.

3. A method for displaying product comprising a) Providing a multiplicity of product containers, each having a cap; and b) Loading the multiplicity of product containers into a rack having a multiplicity of locations for containers, wherein the rack has (i) a light emitting diode above each of a plurality of locations for the product containers and disposed to direct light onto the cap, wherein the cap is translucent; or (ii) a plurality of means for providing a source of current to the conductors of a cap, said cap comprising a light source contained within the cap; and a pair of conductors adapted to be in contact with a source of current exterior to the cap, the conductors being disposed so as to conduct current to illuminate the light source when they are in contact with the source of current exterior to the cap, whereby the caps of a plurality of the product containers are illuminated.

* * * * *